US008403168B2

(12) United States Patent
Samson et al.

(10) Patent No.: US 8,403,168 B2
(45) **Date of Patent: *Mar. 26, 2013**

(54) CUP ASSEMBLY

(75) Inventors: Ilan Samson, London (GB); Joshua Lieberman, Pompton Lakes, NJ (US)

(73) Assignee: Playtex Products, Inc., Westport, CT (US)

( * ) Notice: Subject to any disclaimer, the term of this patent is extended or adjusted under 35 U.S.C. 154(b) by 677 days.

This patent is subject to a terminal disclaimer.

(21) Appl. No.: 11/601,300

(22) Filed: Nov. 17, 2006

(65) Prior Publication Data

US 2007/0062942 A1 Mar. 22, 2007

Related U.S. Application Data

(62) Division of application No. 10/781,048, filed on Feb. 18, 2004, now Pat. No. 7,147,126.

(60) Provisional application No. 60/448,184, filed on Feb. 18, 2003.

(51) Int. Cl.
*B65D 51/16* (2006.01)

(52) U.S. Cl. ..... 220/374; 220/703; 220/369; 220/711

(58) Field of Classification Search ..... 220/203.11, 220/714, 374, 710, 711, 713, 369, 703, 716
See application file for complete search history.

(56) References Cited

U.S. PATENT DOCUMENTS

| | | | | |
|---|---|---|---|---|
| 2,456,989 | A * | 12/1948 | Polcyn | 220/713 |
| 2,507,557 | A | 5/1950 | Chester | 222/455 |
| 2,914,214 | A | 11/1959 | Messinger | 220/90.4 |
| 3,102,651 | A | 9/1963 | Boese | 215/43 |
| 3,211,811 | A | 10/1965 | Lanman | 264/2.3 |
| 3,877,614 | A | 4/1975 | Murphy | 222/209 |
| 4,322,014 | A | 3/1982 | Philip | 220/713 |
| 4,394,928 | A | 7/1983 | Philip | 220/373 |
| 4,442,948 | A * | 4/1984 | Levy et al. | 220/710 |
| 4,596,341 | A | 6/1986 | Bruffey | 220/705 |
| 4,795,052 | A * | 1/1989 | Hayes, Jr. | 220/711 |
| 4,869,390 | A | 9/1989 | Kennedy | 220/709 |
| 4,915,250 | A * | 4/1990 | Hayes, Jr. | 220/711 |
| 5,211,298 | A | 5/1993 | Bloch | |
| 5,439,125 | A | 8/1995 | Bloch | |
| D368,624 | S | 4/1996 | Forrer | 220/392.1 |
| 5,538,157 | A | 7/1996 | Proshan | 220/717 |
| 5,560,513 | A | 10/1996 | Jarrell | |
| 5,598,945 | A | 2/1997 | Gracy | |
| 6,305,571 | B1 * | 10/2001 | Chu | 220/719 |
| 6,422,415 | B1 | 7/2002 | Manganiello | 220/714 |
| 6,811,049 | B2 | 11/2004 | Lukacevic | 220/254.3 |
| 7,111,749 | B1 * | 9/2006 | Akers | 220/359.2 |
| 7,147,126 | B2 * | 12/2006 | Samson et al. | 220/711 |

(Continued)

FOREIGN PATENT DOCUMENTS

| | | |
|---|---|---|
| GB | 2317608 | 4/1998 |
| WO | WO 01/12031 A1 | 2/2001 |

*Primary Examiner* — Anthony Stashick
*Assistant Examiner* — Christopher McKinley
(74) *Attorney, Agent, or Firm* — Ohlandt, Greeley, Ruggiero & Perle, L.L.P.

(57) ABSTRACT

A cup for reducing or eliminating spillage or shake-out. The cup has a cap and a spill and shake-out inhibiting element. The spill and shake-out inhibiting element is a dispensing tunnel, which provides for the formation of a pressure differential between the inside of the cup and the atmosphere when fluid begins to flow through the dispensing tunnel. The pressure differential, when it reaches a predetermined level, prevents further flow or movement of the fluid through the dispensing tunnel until additional suction is applied by the user. The diameter of the dispensing tunnel is small enough to effectively prevent air bubbles from flowing past the fluid in the dispensing tunnel.

8 Claims, 9 Drawing Sheets

U.S. PATENT DOCUMENTS

2002/0033398 A1 3/2002 Freeman et al. ..... 220/713
2002/0038803 A1* 4/2002 Malcolm ..... 220/713
2002/0053574 A1 5/2002 Thompson ..... 220/710
2005/0087539 A1* 4/2005 Waller ..... 220/713

* cited by examiner

CUP ASSEMBLY

CROSS REFERENCE TO RELATED APPLICATIONS

This application is a divisional of, and claims priority to, U.S. patent application Ser. No. 10/781,048, filed Feb. 18, 2004 now U.S. Pat. No. 7,147,126, which claims priority to Provisional Application Ser. No. 60/448,184, filed Feb. 18, 2003. Each of the above-cited documents is incorporated herein by reference.

BACKGROUND OF THE INVENTION

1. Field of the Invention

The present invention relates to cup assemblies. More particularly, the present invention relates to a spill-proof cup assembly, and, in particular, a spill-proof cup assembly with a spill and shake-out inhibiting element.

2. Description of the Related Art

Cup assemblies designed to reduce or eliminate leakage or spillage are known. Such cup assemblies often employ valves or flow control elements that attempt to prevent unwanted dispensing of fluid held within the cup. Typically, such cup assemblies require hard or increased suction to be applied to the valve or flow control element for the fluid to pass through to the user, which is often due to the use of a blockage or obstruction disposed in the flow path or passageway.

An example of such a cup assembly and valve or flow control mechanism is disclosed in U.S. Pat. No. 6,422,415 to Manganiello. The Manganiello device includes a cup having an open end and a cap adapted to seal the open end. The cap has a drinking spout and a mating surface, with the mating surface being in fluid communication with the spout. The device also has a valving element that has a stack. The stack is sized and configured to engage the mating surface and thereby place the stack in fluid communication with the spout. The stack has a top portion with a concave valve face in the top portion that curves inwardly towards the stack.

An alternative type of flow control element is disclosed in U.S. Pat. No. 4,915,250 to Hayes. The Hayes device includes a container and a lid. The lid has a tubular chamber formed in the lid. The tubular chamber is a single circular or helical loop that is disposed along an outer area of the lid.

In operation, when the Hayes container is tilted between an upright vertical position and a horizontal position, i.e., rotation of up to 90°, any fluid that seeks to exit the container through the tubular chamber would be required to flow through a path along the circumference of the lid. The circumferential path would require the fluid to flow above the level of the fluid in the container, which it may not be able to do. Thus, the Hayes device intends that the fluid be prevented from exiting through the tubular chamber because the fluid cannot rise above the level of the fluid in the container. As an example, when the Hayes container is tilted or rotated to the horizontal, i.e., rotated 90°, the fluid in the tubular chamber would be required to flow up to the highest point of the lid (along the circumference), which we will call the apex of the tubular chamber. The fluid in the container is below the apex or highest point of the lid and thus fluid flow above the level of fluid in the container, past the apex of the tubular chamber, is intended to be prevented.

However, the Hayes device suffers from the drawback of leakage or spillage when the container is tilted past the horizontal, i.e., when the cup is turned between 90° and 270°. In such an orientation, which we will call upside-down or inverted for simplicity, the fluid in the container will cover the bottom side of the lid if there is enough fluid in the container. At a 180° orientation, i.e., completely upside-down or inverted, the fluid in the container is clearly covering the entire bottom side of the lid. With the fluid covering the bottom side of the lid, the path provided by the tubular chamber no longer requires any exiting fluid to flow above the level of liquid inside the container. At such an orientation of the container, i.e., upside-down or inverted, fluid can freely flow through the tubular chamber under the force of gravity and will spill or leak out of the container.

Additionally, the Hayes device can suffer from the drawback of spillage when the container is shaken. When being shaken, portions of the fluid in the tubular chamber near the apex of the tubular chamber can move past the apex due to the shaking motion. This portion of the fluid will then flow through the remainder of the tubular chamber and out of the container.

Many of the contemporary spill-proof cup assemblies suffer from the drawback of failing to eliminate significant or continuous spillage or shake-out of the fluid inside of the cup. Moreover, the contemporary devices do not facilitate drinking because increased suction is necessary to allow flow due to the use of a blockage structure in the flow path. The contemporary devices also do not facilitate cleaning of the flow control elements because they are difficult to access and have a small size that makes thoroughly cleaning difficult.

SUMMARY OF THE INVENTION

It is an object of the present invention to provide a cup assembly that reduces or eliminates significant or continuous spillage or shake-out.

It is another object of the present invention to provide such a cup assembly that reduces or eliminates significant or continuous spillage or shake-out for any orientation of the cup assembly.

It is yet another object of the present invention to provide such a cup assembly that reduces or eliminates significant or continuous spillage or shake-out when the cup assembly is shaken or dropped.

It is still another object of the present invention to provide such a cup assembly that facilitates the cleaning of the cup assembly including the cleaning of a spill and shake-out inhibiting element of the cup assembly.

It is a further object of the present invention to provide such a cup assembly that facilitates the manufacturing of the spill and shake-out inhibiting element of the cup assembly.

It is yet a further object of the present invention to provide such a cup assembly that does not require a spout.

It is still a further object of the present invention to provide such a cup assembly which inhibits spillage and shake-out without the use of blockages in the flow path.

It is another further object of the present invention to provide such a cup assembly which reduces or limits the turbulence through the flow path, such as, for example, by constructing the flow path without sharp corners.

It is yet another further object of the present invention to provide such a cup assembly in which the spill and shake-out inhibiting facilities can be confined to a portion of the cap, such as, for example, preferably half of the cap.

It is still another further object of the present invention to provide such a cup assembly that facilitates assembly of the components of the cup assembly.

These and other objects and advantages of the present invention are provided by a cup assembly that requires a negative pressure, i.e., a suction force, to be applied to an aperture in the cup assembly in order to dispense fluid out of the assembly. Preferably, the cup assembly requires a small negative pressure or suction force to dispense fluid from the assembly. The cup assembly has a cup, a cap adapted to be removably connected to the cup, and a spill and shake-out inhibiting element positioned in the cup and/or cap. The spill and shake-out inhibiting element forms a dispensing tunnel or channel with the cap, which provides for the formation of a partial vacuum inside the cup resulting in a pressure differential between the inside of the cup and the atmosphere when fluid begins to flow along the dispensing tunnel. The partial vacuum or pressure differential prevents further flow of the fluid along the dispensing tunnel to prevent or limit spillage or shake-out.

The pressure differential results because the displacement of fluid out of the cup causes air in the cup to expand, which reduces the pressure in the cup. When the sub-pressure in the cup equals the pressure of the fluid-head furthest along the tunnel, the further ingress of the fluid into the dispensing tunnel ceases. The cross-sectional area or diameter of the dispensing tunnel is small enough to effectively limit or prevent air bubbles from flowing past the fluid in the dispensing tunnel, even when shaken, so that the pressure differential is maintained. The volume of the dispensing channel is large enough that the fluid front does not exceed a predetermined distance away from the outlet of the dispensing tunnel at any degree of fill of the cup so that spillage or shake-out is essentially prevented even when the cup assembly is shaken.

Preferably, the spill and shake-out inhibiting element is a removable structure, and more preferably a removable disc or other shape. The disc preferably has a channel formed in an upper surface thereof, which forms the dispensing tunnel when the channel is abutted against the lower surface of the cap. Preferably, all of the banks of the channel sealingly engage with the lower surface of the cap or lid. The channel sealing area can be confined to only a portion of the cap area, such as, for example, half of the cap. The removable disc can have a diameter that allows for an interference fit with the sidewall of the cap or lid. Preferably, the dispensing channel is formed without sharp corners.

In one aspect, a valve is provided for use with a cup having a cap and an inner volume. The valve has a passageway having first and second ends. The first end is open and in fluid communication with the inner volume of the cup, and the second end is open and in fluid communication with atmosphere. The passageway has a cross-sectional area that is small enough to substantially prevent air from flowing past fluid in the passageway when the cup is tilted or inverted. The passageway is confined to, or disposed in, a first planar section having a first longitudinal axis. The cap is confined to, or disposed in, a second planar section having a second longitudinal axis. The first and second longitudinal axes are substantially parallel.

In another aspect, a cap is provided for use with a cup having an inner volume. The cap has a top wall having a first connecting structure that removably connects the cap with the cup. The cap also has a valve having a passageway with first and second ends. The first end is open and in fluid communication with the inner volume of the cup, and the second end is open and in fluid communication with atmosphere. The passageway has a cross-sectional area that is small enough to substantially prevent air from flowing past fluid in the passageway when the cup is tilted or inverted. The passageway is confined to, or disposed in, a first planar section having a first longitudinal axis. The cap is confined to, or disposed in, a second planar section having a second longitudinal axis. The first and second longitudinal axes are substantially parallel.

In another aspect, a bottle assembly is provided that has a cup, a cap and a valve. The cap has a top wall and a first connecting structure. The cup has an inner volume and a second connecting structure. The first and second connecting structures connect the cap with the cup. The valve has a passageway with first and second ends. The first end is open and in fluid communication with the inner volume of the cup, and the second end is open and in fluid communication with atmosphere. The passageway has a cross-sectional area that is small enough to substantially prevent air from flowing past fluid in the passageway when the cup is tilted or inverted. The passageway is confined to, or disposed in, a first planar section having a first longitudinal axis. The cap is confined to, or disposed in, a second planar section having a second longitudinal axis. The first and second longitudinal axes are substantially parallel.

In another aspect, a bottle assembly is provided that has a cap, a cup and a valve. The cap has a top wall, a circumferential sidewall, and a first connecting structure. The circumferential sidewall surrounds the top wall, and the first connecting structure is disposed on the circumferential sidewall. The cup has an inner volume and a second connecting structure. The first and second connecting structures connect the cap with the cup. The valve has a passageway with first and second ends. The first end is open and in fluid communication with the inner volume of the cup, and the second end is open and in fluid communication with atmosphere. At least a portion of the top wall is recessed with respect to the circumferential sidewall to form a lip. The lip at least partially circumscribes the top wall and has an opening therethrough. The opening is in fluid communication with the second end of the passageway.

In another aspect, a bottle assembly is provided that has a cap, a cup and a valve. The cap has a top wall and a first connecting structure. The top wall has an upper surface. The cup has an inner volume and a second connecting structure. The first and second connecting structures connect the cap with the cup. The valve has a passageway with first and second ends. The first end is open and is in fluid communication with the inner volume of the cup. The second end is open and is in fluid communication with atmosphere. The passageway has a cross-sectional area that is small enough to substantially prevent air from flowing past fluid in the passageway when the cup is tilted or inverted. The passageway is substantially disposed below the upper surface of the cap.

The passageway can have a length and a dispensing volume, where the length and the dispensing volume are large enough to substantially prevent spillage or shake-out of the fluid from the inner volume of the cup when the cup is tilted or inverted. The cross-sectional area may be substantially uniform along the passageway. The cross-sectional area can be substantially circular. The cap can also have a spout in fluid communication with the second end of the passageway. The passageway can be at least partially formed from a first channel and a second channel, and the first and second channels can be sealingly connectable.

The first and second channels can have substantially the same path, where the first channel forms a lower portion of the passageway and the second channel forms an upper portion of the passageway. At least one of the first and second channels may be formed on the cap, and can also be substantially disposed on only half of the cap. The passageway can have a serpentine-like path. The passageway can be at least partially formed from a first channel and a second channel that are sealingly connectable, where the first and second channels have substantially the same path and form lower and upper portions of the passageway, and where the first channel is formed on a disc and the second channel is formed on the cap.

The disc can be removably connectable to the cap. The disc may be flexible. The disc can have an upper surface, and the first channel can have sealing beads disposed along the path or banks of the first channel that extend above or beyond the upper surface. The disc may have a first orientation structure, and the cap may have a second orientation structure, where the first and second orientation structures align the first and second channels when the disc is connected with the cap. The passageway can be disposed in a first planar section having a first longitudinal axis and the cap can be disposed in a second planar section having a second longitudinal axis, where the first and second longitudinal axes are substantially parallel.

BRIEF DESCRIPTION OF THE DRAWINGS

Other and further objects, advantages and features of the present invention will be understood by reference to the following.

DESCRIPTION OF THE INVENTION

Figure 1:
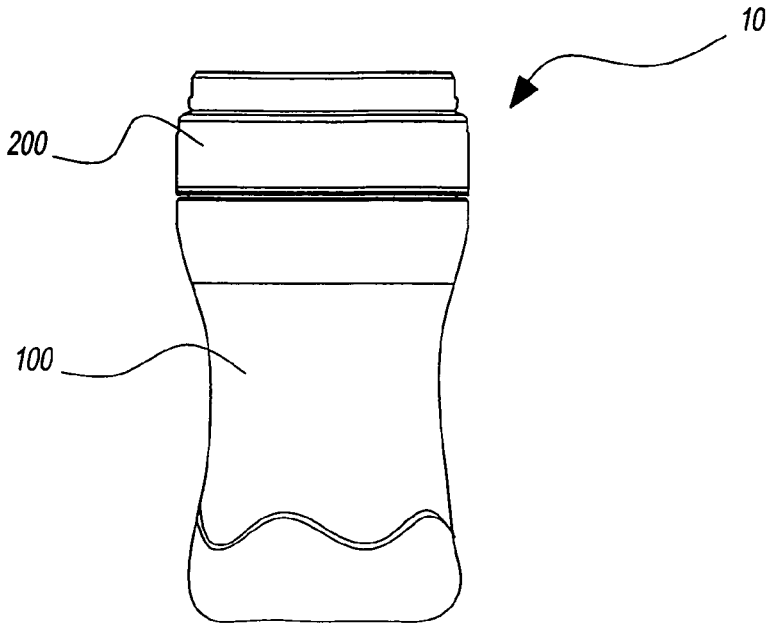
FIG. 1 is a plan view of a cup assembly of the present invention.

Referring to the drawings and, in particular, FIGS. 1 through 6, there is shown a preferred embodiment of a cup assembly of the present invention generally represented by reference numeral 10. Cup assembly 10 has a cup or container 100, a cap or lid 200 that can be removably connected or secured to the cup, and a disc 300.

Figure 2:
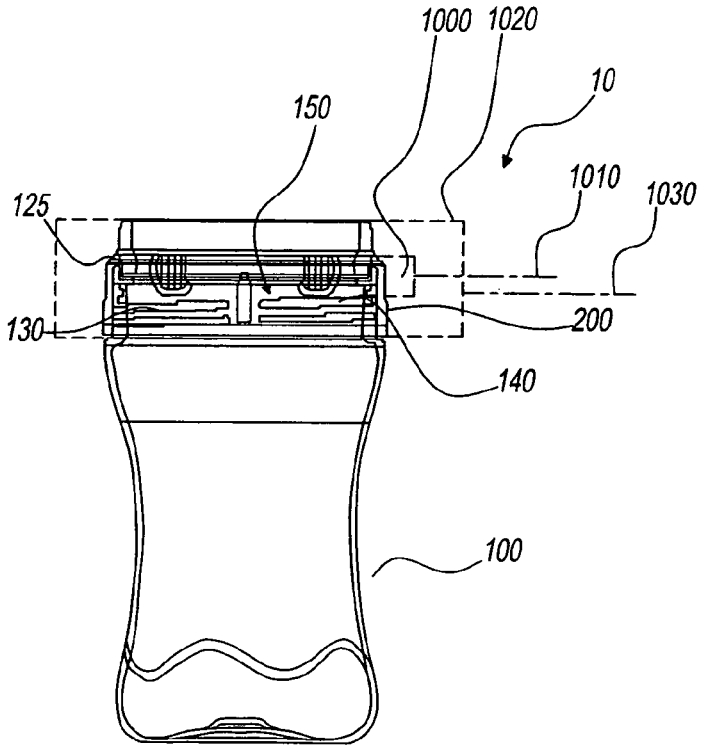
FIG. 2 is a plan view of the cup assembly of FIG. 1 with the cap shown in phantom.

Referring to FIGS. 1 and 2, cup 100 has a generally cylindrical shape defining an inner volume 110, but alternative shapes such as conical, hourglass, or even amorphic can also be used. Cup 100 has a top portion 120 having a rim 125 and an outer surface 130. Outer surface 130 has a fastening or connecting structure 140 disposed thereon. Preferably, fastening structure 140 has threads. Rim 125 defines an open end 150 of cup 100, which provides access to the inner volume.

Figure 3:
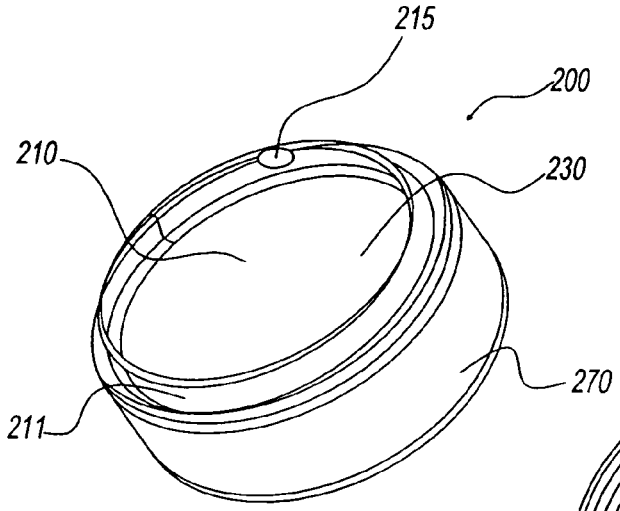
FIG. 3 is a top perspective view of the cap of FIG. 1.
Figure 4:
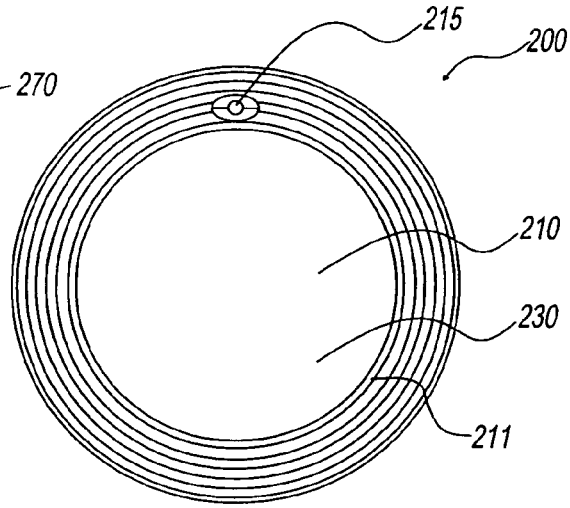
FIG. 4 is a top view of the cap of FIG. 3.
Figure 5:
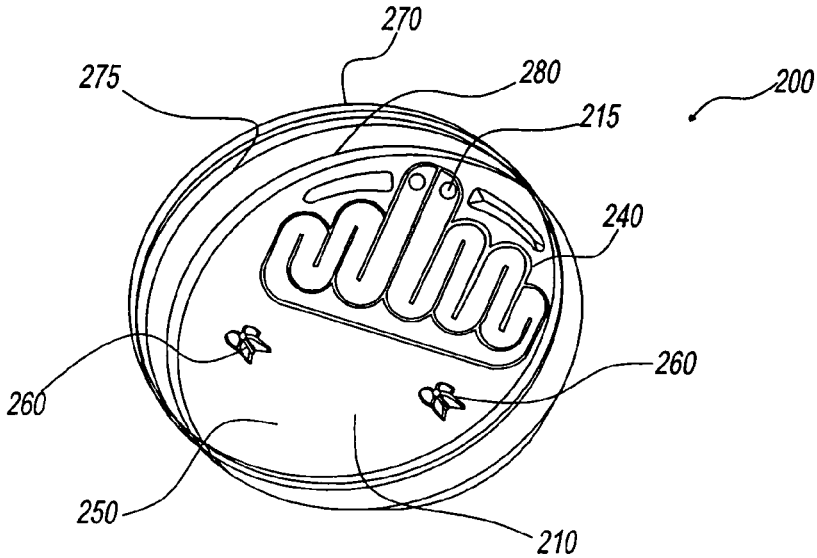
FIG. 5 is a bottom perspective view of the cap of FIG. 3.
Figure 6:
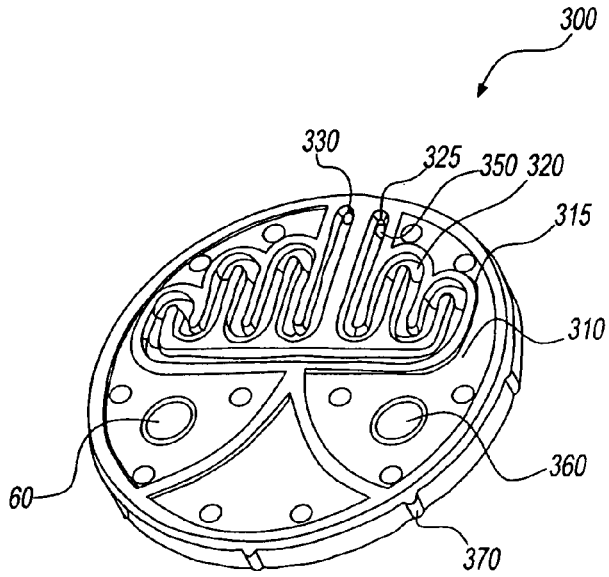
FIG. 6 is a top perspective view of a preferred embodiment of a spill and shake-out inhibiting element or disc, of the cup assembly of FIG. 1.
Figure 7:
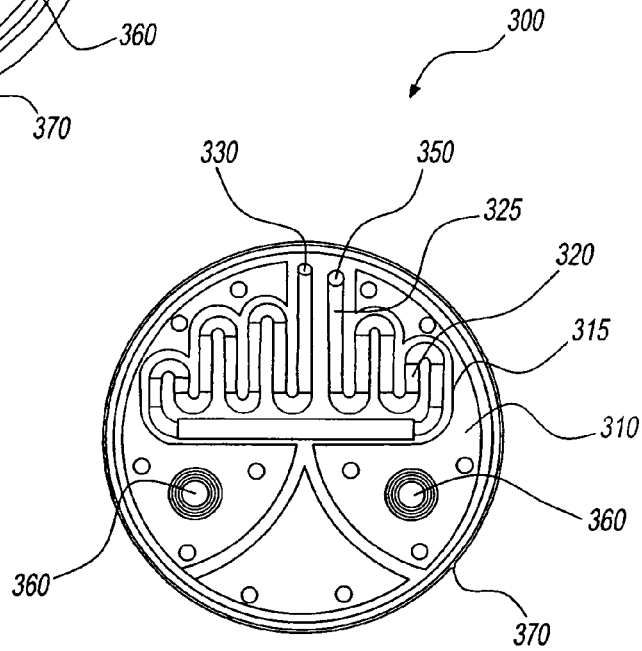
FIG. 7 is a top view of the disc of FIG. 6.

Referring to FIGS. 3 through 5, cap 200 has a top wall 210 with an upper surface 230 and a lower surface 250. Cap 200 also has a circumferential sidewall 270 extending downwardly from, and surrounding, top wall 210. Top wall 210 can be curved or flat, and has an opening 215 disposed through it. Top wall 210 has an elevated drinking rim or lip 211 near the circumference of the cap. Preferably, top wall 210 is recessed with respect to circumferential sidewall 270 to form rim or lip 211. The present invention also contemplates recessing only a portion of top wall 210 so as to form lip 211 only along a portion of cap 200.

Opening 215 is disposed along the periphery or circumference of the cap 200, and is preferably located on the ridge of drinking rim 211. Cup assembly 10 can have a substantially flat upper surface without a drinking rim and can also have other configurations, such as, for example, a drinking spout. Likewise, opening 215 can be disposed in alternative positions along top wall 210, such as, for example, in proximity to the center of the top wall.

Sidewall 270 has an inner surface 275 with a connecting or fastening structure 280 disposed thereon. Preferably, fastening structure 280 has threads that are engageable with threads 140 of cup 100. The transition into opening 215 is preferably rounded.

Lower surface 250 of cap 200 preferably has a slight curvature and is perpendicular to the longitudinal axis of cup 100 when cap 200 is engaged with the cup. Lower surface 250 has a sealing bead 240 and orientation features 260. Sealing bead 240 is preferably a rigid structure. Orientation features 260 are two projections that are disposed remotely from each other. Preferably, orientation features 260 extend from lower surface 250 parallel to the longitudinal axis of cup 100. More preferably, orientation features 260 are two cross-shaped projections. However, alternative shapes can also be used for orientation features 260, such as, for example, cylindrical projections.

The rigid sealing bead 240 has a serpentine path that is designed to mate with a flexible sealing bead 315 on top surface 310 of disc 300. When the flexible sealing bead 315 on the top surface 310 of disc 300 is sealingly engaged with the lower surface 250 of cap 200, the rigid sealing bead 240 further improves the seal around, and adjacent to, channel 320 in disc 300.

Referring to FIGS. 6 through 9, disc 300 is a circular-shaped disc that has a diameter slightly smaller than the inner diameter of the threads 280 on sidewall 270 of FIG. 5. Preferably, disc 300 is made from a flexible material that is over-molded onto a rigid material, such as, for example, rubber or silicone over-molded onto a rigid plastic material. Securing features 370 on the outer circumference of disc 300 are protrusions made of the flexible material that have a slight interference fit with the threads 280 when the disc 300 is assembled to the cap 200. This interference fit retains the disc 300 in cap 200 when the cap is inverted for assembly with the cup 100.

Disc 300 has an upper surface 310, an orifice 350 and orientation features 360. Upper surface 310 has a channel 320 formed therein. A flexible sealing bead 315 is formed on upper surface 310 that is adjacent to, and surrounds, channel 320. Preferably, the flexible sealing bead 315 is formed along all of the banks of channel 320. The flexibility of sealing bead 315 provides for a sealing engagement of channel 320 to lower surface 250 of cap 200. Channel 320 has an inlet 325 and an outlet 330. Channel 320 has a substantially semi-circular or U-shaped cross-section. However, other cross-sectional shapes can be used for channel 320. The transition from inlet 325 into orifice 350 is preferably rounded.

The inlet 325 of channel 320 has orifice 350 disposed therethrough. Orifice 350 is disposed all the way through disc 300. When disc 300 is engaged with cap 200 and the cap is engaged with cup 100, orifice 350 is in fluid communication with the inner volume of the cup and, thus, channel 320 is in fluid communication with the inner volume. The outlet 330 of channel 320 is a closed end. When the disc 300 is sealingly engaged with the cap 200, the outlet 330 aligns with the opening 215 in the cap. Preferably, the inlet 325 is disposed near the outer circumference of disc 300 to reduce the residual liquid in the cup assembly 10 when the user is finished drinking.

Channel 320 preferably has a serpentine-like path or shape. More preferably, channel 320 is substantially disposed on one-half or less than one-half of the area of disc 300. However, alternative paths and shapes can be used for channel 320, such as, for example a spiral shape that is substantially disposed in the center portion of upper surface 310. The paths used for channel 320 preferably do not have sharp corners. Avoiding sharp corners within channel 320 reduces or limits the turbulence created along the flow path through channel 320.

Orientation recesses 360 are cavities or recesses formed in upper surface 310. Preferably, orientation recesses 360 are two cylindrical recesses disposed remotely from each other that have a diameter and depth that allow for engagement with orientation features 260 (cross-shaped projections) formed in lower surface 250 of cap 200 shown in FIG. 5. Alternative shapes and sizes can also be used for orientation recesses 360 which correspond to, and allow for engagement with, the shape and size of orientation features 260.

Figure 8:
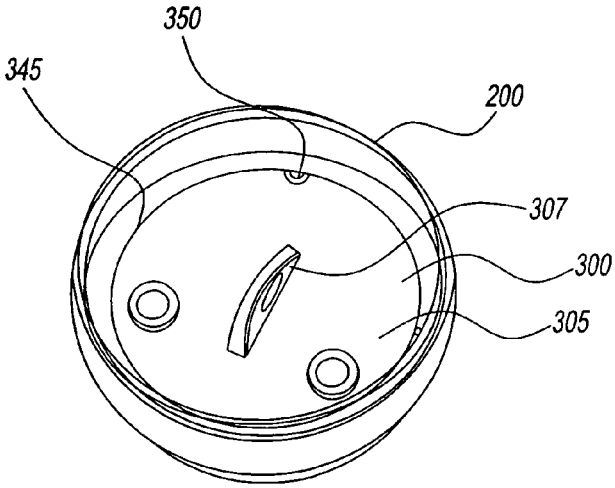
FIG. 8 is a bottom perspective view of the disc of FIG. 6 assembled with the cap of FIG. 3.

Referring to FIG. 8, a flexible sealing rim 345 is located on the lower surface 305 of disc 300 along the circumference of the disc. When the cup 100 is assembled to the cap 200, the flexible sealing rim 345 sealingly engages the rim 125 of cup 100. This engagement contains the inner volume 110 of the cup 100, restricting flow of any liquid or air into or out of the inner volume to pass through the orifice 350 of channel 320 in the top surface 310 of disc 300.

The following description is when disc 300 is assembled with cap 200 such that lower surface 250 of the cap is sealingly engaged with the flexible sealing bead 315 on upper surface 310 of the disc. When assembled, orientation recesses 360 on upper surface 310 of disc 300 engage with orientation features 260 on lower surface 250 of cap 200. The engagement of the orientation features 260 and orientation recesses 360 ensure the alignment of the outlet 330 of disc 300 with opening 215 in cap 200 and the rigid sealing bead 240 of cap 200 with the flexible sealing bead 315 of disc 300. Preferably, flexible sealing bead 315 compresses against lower surface 250 of cap 200 and overlays rigid sealing bead 240 of cap 200.

Disc 300 preferably has a gripping or position member 307. In the embodiment of FIG. 8, gripping member 307 is a finger grip disposed in the center portion of bottom surface 305 so that a user can more easily position, engage or remove disc 300 with cap 200. The size and shape of finger grip 307 can be varied to facilitate gripping by the user.

Figure 9:
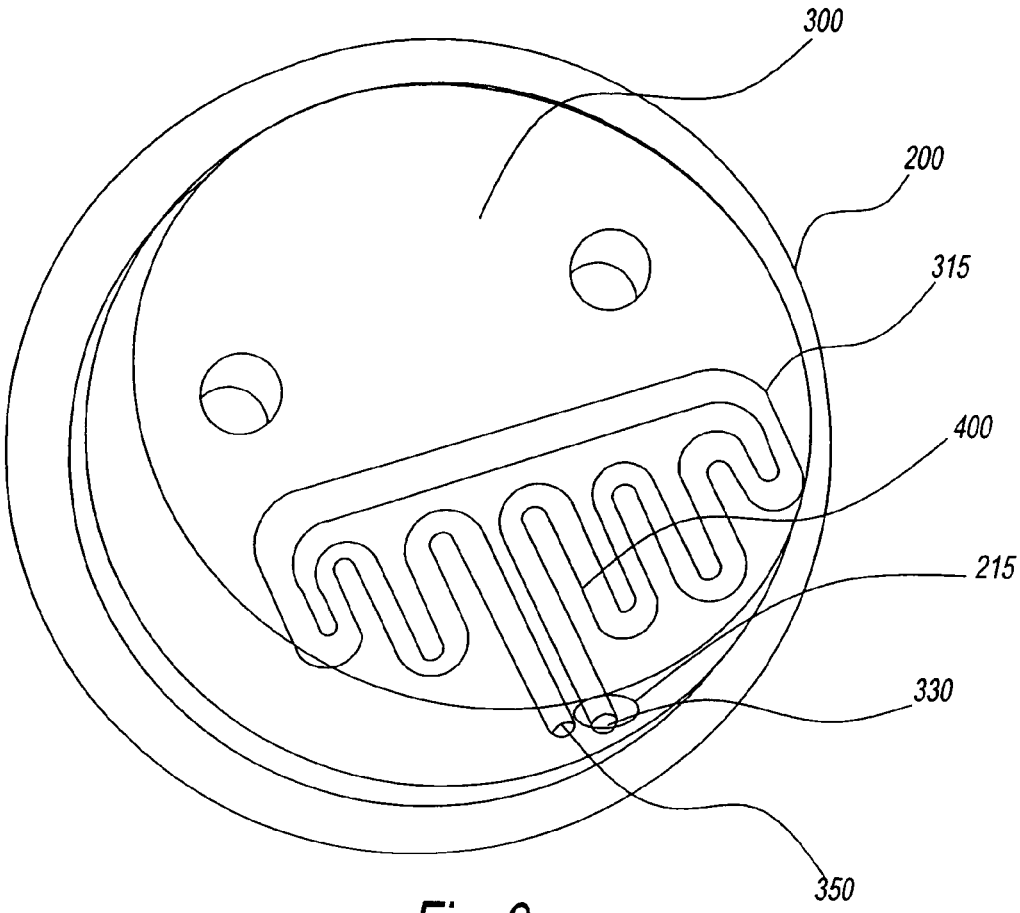
FIG. 9 is a top perspective view of a top portion of the cup assembly of FIG. 1 with the cap shown in phantom.
Figure 10:
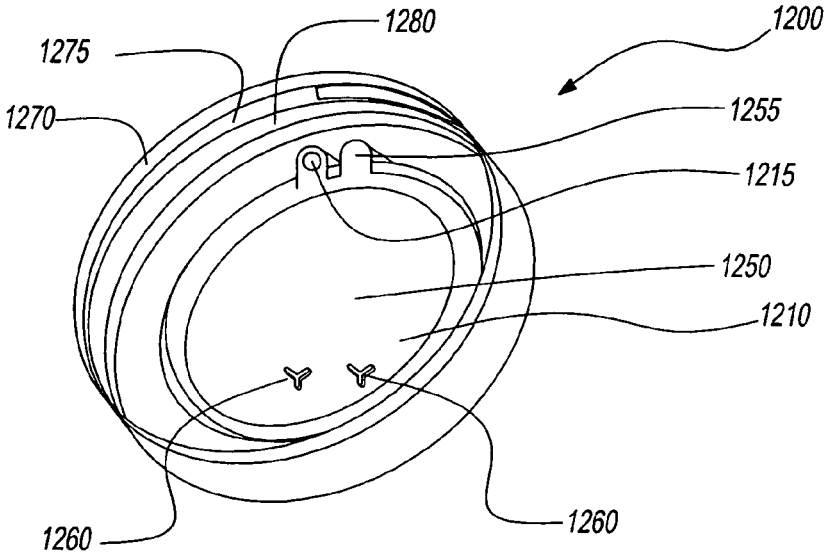
FIG. 10 is a bottom perspective view of an alternative embodiment of the cap of the present invention.
Figure 11:
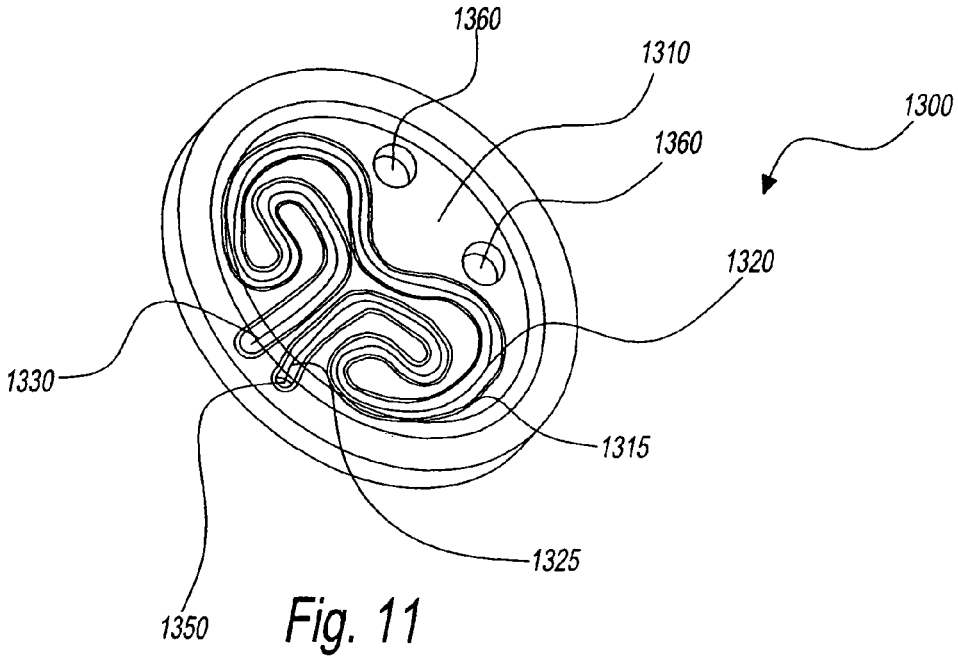
FIG. 11 is a top perspective view of an alternative embodiment of a spill and shake-out inhibiting element or disc, of the present invention.
Figure 12:
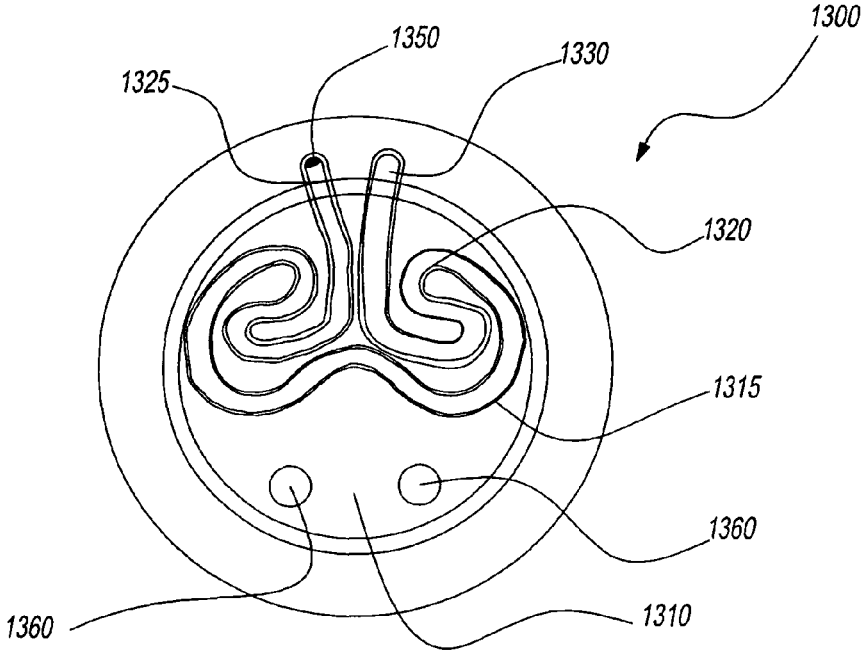
FIG. 12 is a top view of the disc of FIG. 11.
Figure 13:
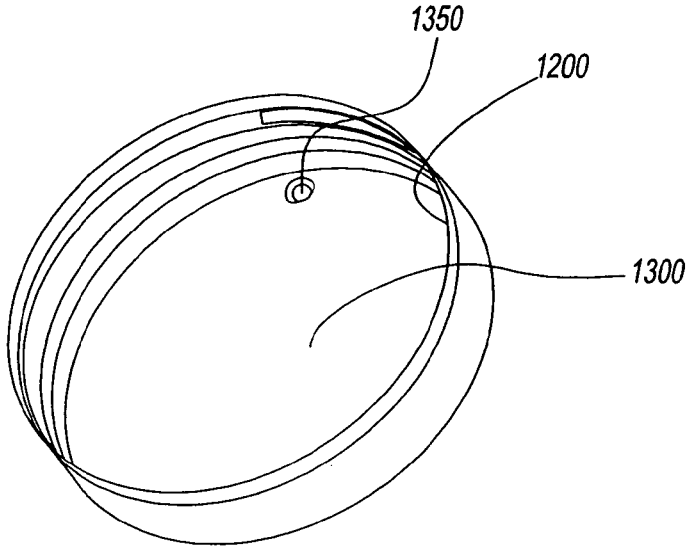
FIG. 13 is a bottom perspective view of the disc of FIG. 11 assembled with the cap of FIG. 10.
Figure 14:
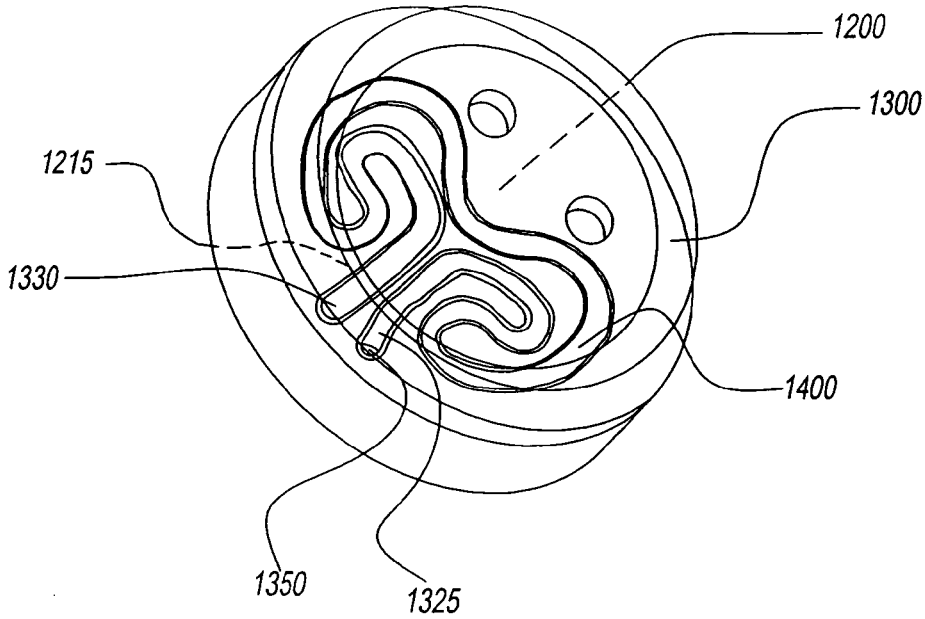
FIG. 14 is a top perspective view of the cap of FIG. 10 with the disc of FIG. 11 and the cap shown in phantom.

Referring to FIG. 9, disc 300 is shown sealingly engaged with cap 200, with the cap shown in phantom. The sealing engagement of flexible sealing bead 315 with lower surface 250 of cup 200 forms a dispensing passageway, tunnel or channel 400, which is the spill and shake-out inhibiting element of the present invention. When cap 200 is engaged with cup 100, dispensing tunnel 400 provides for fluid communication between inner volume 110 of the cup and the user's mouth or the atmosphere. In the preferred embodiment, dispensing tunnel 400 is formed as a two-piece structure whereby the separate upper and lower pieces (channel 320 and lower surface 250) are brought together to form an enclosed tunnel. However, the present invention contemplates alternative ways being used to form dispensing tunnel 400.

Referring to FIG. 2, dispensing tunnel or passageway 400 is located in, disposed in, or confined to, a first planar section 1000, which is represented by the broken lines in FIG. 2. First planar section 1000 has a first longitudinal axis 1010. The cap 200 is located in, disposed in, or confined to, a second planar section 1020, which is represented by the broken lines in FIG. 2. Second planar section 1020 has a second longitudinal axis 1030. The first and second longitudinal axes 1010, 1030 are preferably substantially parallel to each other.

Referring to FIGS. 1 through 9, the spill and shake-out inhibiting features of cup assembly 10 will now be described. Cup assembly 10 requires that a small negative pressure, i.e., a small suction force, be applied to dispensing tunnel 400 in order to dispense fluid out of inner volume 110 through the dispensing tunnel and out through opening 215. The negative pressure or suction force is supplied by the user.

In operation, when cup assembly 10 is tilted or pivoted from an upright vertical position, fluid from the inner volume 110 enters dispensing tunnel 400 through orifice 350. As the fluid flows through dispensing tunnel 400, a partial vacuum develops in the inner 110 volume of cup 100 due to the outflow of fluid from the otherwise sealed cup. The partial vacuum results because the displacement of fluid out of the inner volume 110 causes air in the inner volume to expand, which reduces the pressure in the inner volume. When the sub-pressure in the inner volume equals the pressure of the fluid-head furthest along the dispensing tunnel 400, the ingress of the fluid into the dispensing tunnel ceases. The partial vacuum that develops in the inner volume 110 prevents the fluid from continuing to flow through dispensing tunnel 400.

The cross-sectional area or diameter of dispensing tunnel 400 should be small enough to effectively limit or prevent air bubbles from flowing past the fluid in the dispensing tunnel, even when the cup is shaken. If the cross-sectional area or diameter of dispensing tunnel 400 is too large, then air bubbles will be able to flow past the fluid in the dispensing tunnel (especially if the cup is shaken) and enter the inner volume 110 which would reduce the partial vacuum created in the inner volume and allow additional liquid to flow through the dispensing tunnel and eventually out of the opening 215 in cap 200.

In the present invention, the pressure differential is maintained between the inner volume of cup 100 and the atmosphere by use of an appropriate diameter or cross-sectional area of dispensing tunnel 400 (effectively limiting flow of air bubbles through the dispensing tunnel), which prevents further flow of fluid through the dispensing tunnel. The volume of dispensing tunnel 400 should be large enough so that when the cup is tilted or inverted, the fluid flows partially through the dispensing tunnel but does not reach outlet 330 (of the dispensing tunnel) and opening 215 (of cap 200) and, thus, the fluid is prevented from spilling out of cup 100. Preferably, the volume of dispensing tunnel 400 is large enough so that, with any degree of fill in the cup, the fluid front does not exceed a predetermined distance away from the outlet 330 and opening 215 so that spillage or shake-out is prevented in the event of inverting, shaking or dropping of cup assembly 10.

By way of example only, dispensing tunnel 400 can have a cross-sectional area of about 7 $mm^2$ and a length of about 23 cm for a dispensing tunnel volume of about 1.6 $cm^3$. The cross-sectional area of dispensing tunnel 400 of about 7 $mm^2$ effectively limits air bubbles from flowing past the fluid in the dispensing tunnel and entering the inner volume 110. Thus, the pressure differential between the inner volume and the atmosphere is maintained. One of ordinary skill in the art will recognize that other combinations of cross-sectional areas and lengths of dispensing tunnel 400 can be utilized so that with any degree of fill in the cup, the fluid front does not exceed a predetermined distance away from outlet 330 and opening 215, such that spillage is effectively prevented even when the cup is shaken, i.e., shake-out.

Portions of the fluid flow principles upon which the spill and shake-out inhibiting element of the present invention, i.e., dispensing tunnel 400, are based, are also described in PCT Application PCT/GB00/03055 to Samson, which was published on Feb. 22, 2001, and which is hereby incorporated in its entirety by reference.

In the present invention, fluid flow is stopped in dispensing tunnel 400 as a function of the partial vacuum created in the inner volume or pressure differential between the inner volume and the atmosphere. Thus, fluid flow is not dependent on the orientation of cup 100, cap 200, disc 300 or dispensing tunnel 400. Cup assembly 10 effectively eliminates spillage or shake-out for any orientation of the cup assembly. Additionally, dispensing tunnel 400 effectively eliminates spillage or shake-out even when the cup assembly 10 is shaken or dropped due to the predetermined distance away from opening 215 where the fluid is stopped.

Disc 300 is preferably separable from cap 200, which facilitates the cleaning of the disc. Moreover, dispensing tunnel 400 is preferably formed by the sealing engagement of disc 300 and cap 200 so that when disassembled, dispensing tunnel 400 is easily accessible for cleaning, i.e., channel 320 has an open top. The two-piece design of dispensing tunnel 400 facilitates the manufacturing of disc 300 since the disc only needs a channel 320 formed in upper surface 310 with a flexible sealing bead 315 along all banks of the channel. Cup assembly 10 also does not require a spout to provide a sealing surface for the channel 320 in disc 300.

The present invention also can include cap 200 that is transparent, semi-transparent or transparent over a portion of the cap. The transparency or semi-transparency of cap 200 allows a user to see the flow of liquid through dispensing tunnel 400.

Referring to FIGS. 10 through 14, an alternative embodiment of the cap and disc of the present invention is shown and generally represented by reference numerals 1200, 1300, respectively. Cap 1200 has a top wall 1210 with an upper surface 1230 and a lower surface 1250. Cap 1200 also has a circumferential sidewall 1270 extending downwardly from, and surrounding, top wall 1210. Top wall 1210 has an opening 1215 disposed through it and an abutment surface 1255. Opening 1215 is disposed along the periphery or circumference of the cap 1200. Sidewall 1270 has an inner surface 1275 with a fastening structure 1280 disposed thereon. Preferably, fastening structure 1280 has threads that are engageable with threads 140 of cup 100.

Lower surface 1250 has orientation features 1260 which are two projections that are disposed remotely from each other. Preferably, orientation features 1260 extend from lower surface 1250 parallel to the longitudinal axis of cup 100. More preferably, orientation features 1260 are two Y-shaped projections. However, alternative shapes can also be used for orientation features 1260, such as, for example, cylindrical projections.

Disc 1300 has an upper surface 1310, an orifice 1350 and orientation recesses 1360. Upper surface 1310 has a channel or groove 1320 formed therein. Channel 1320 has an inlet 1325 and an outlet 1330. Inlet 1325 has an orifice 1350 disposed therethrough. Inlet 1325 and outlet 1330 are disposed adjacent to each other on upper surface 1310 of disc 1300. Channel 1320 has a serpentine-like path or shape. Orientation recesses 1360 are formed in upper surface 2310 and engage with orientation features 1260 of cap 1200 such that opening 1215 aligns with outlet 1330 and abutment surface 1255 aligns with orifice 1350. In this embodiment, channel 1320 has all of its banks surrounded by a sealing bead 1315, which sealingly engages with lower surface 1210 of cap 1200 to form dispensing tunnel 1400. Dispensing tunnel 400 is an alternative spillage and shake-out inhibiting element of the present invention being in fluid communication with opening 1215 and inner volume 110.

Figure 15:
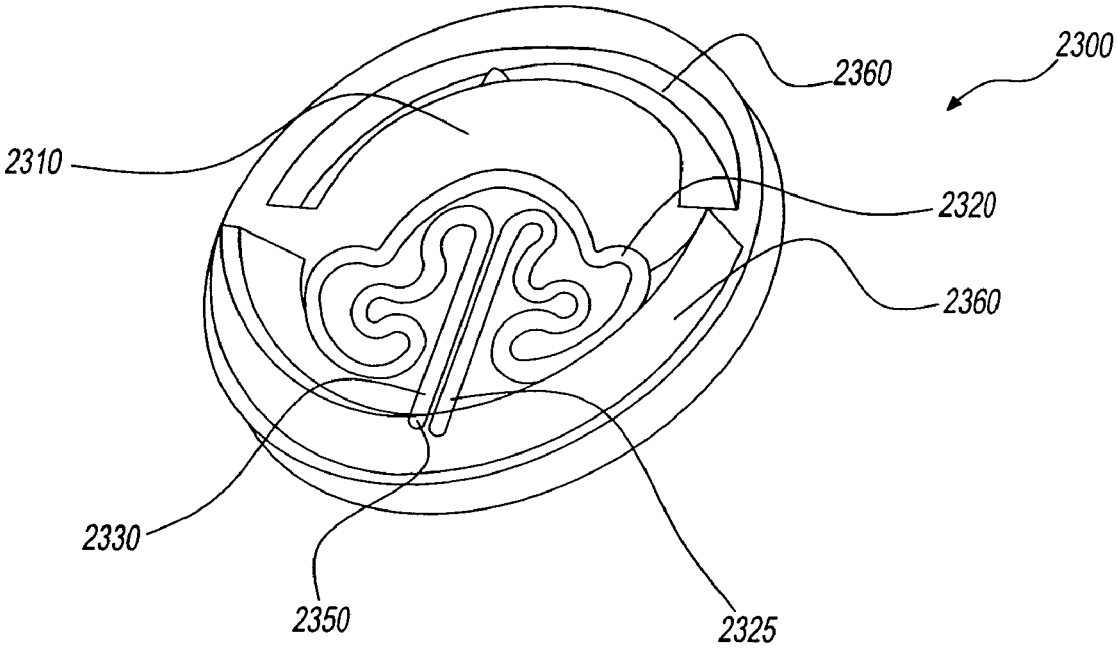
FIG. 15 is a top perspective view of an alternative embodiment of a spill and shake-out inhibiting element or disc, of the present invention.
Figure 16:
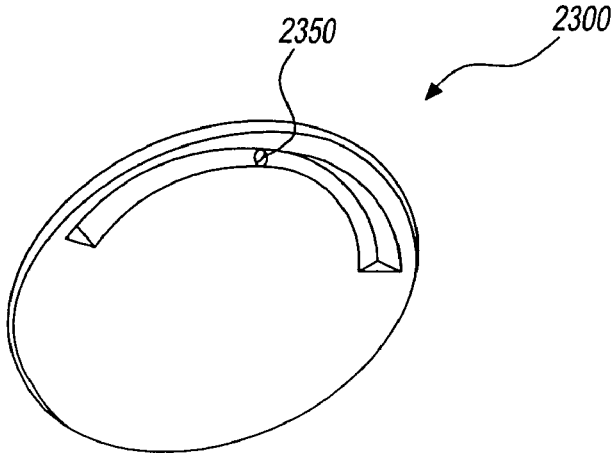
FIG. 16 is a bottom perspective view of the disc of FIG. 15.

Referring to FIGS. 15 and 16, another alternative embodiment of the disc of the present invention is shown and generally represented by reference numeral 2300. Disc 2300 has an upper surface 2310, an orifice 2350 and orientation structures 2360. Upper surface 2310 has a channel or groove 2320 formed therein. Channel 2320 has an inlet 2325 and an outlet 2330.

Inlet 2325 has an orifice 2350 disposed therethrough. Inlet 2325 and outlet 2330 are disposed adjacent to each other on upper surface 2310 of disc 2300. Channel 2320 has a mushroom-like path or shape.

Orientation structures 2360 are a projection and recess formed in upper surface 2310. Preferably, orientation structures 2360 are formed along the outer periphery or circumference of upper surface 2310. More preferably, orientation structures 2360 are a substantially triangular projection and substantially triangular recess formed in upper surface 2310. Orientation structures 2360 have a height or depth that allow for engagement with corresponding orientation structures (not shown) of the same shape and size formed on lower surface 250 of cap 200. Disc 2300 sealingly engages with cap 200 to form the dispensing tunnel or spillage and shake-out inhibiting element of this embodiment.

Figure 17:
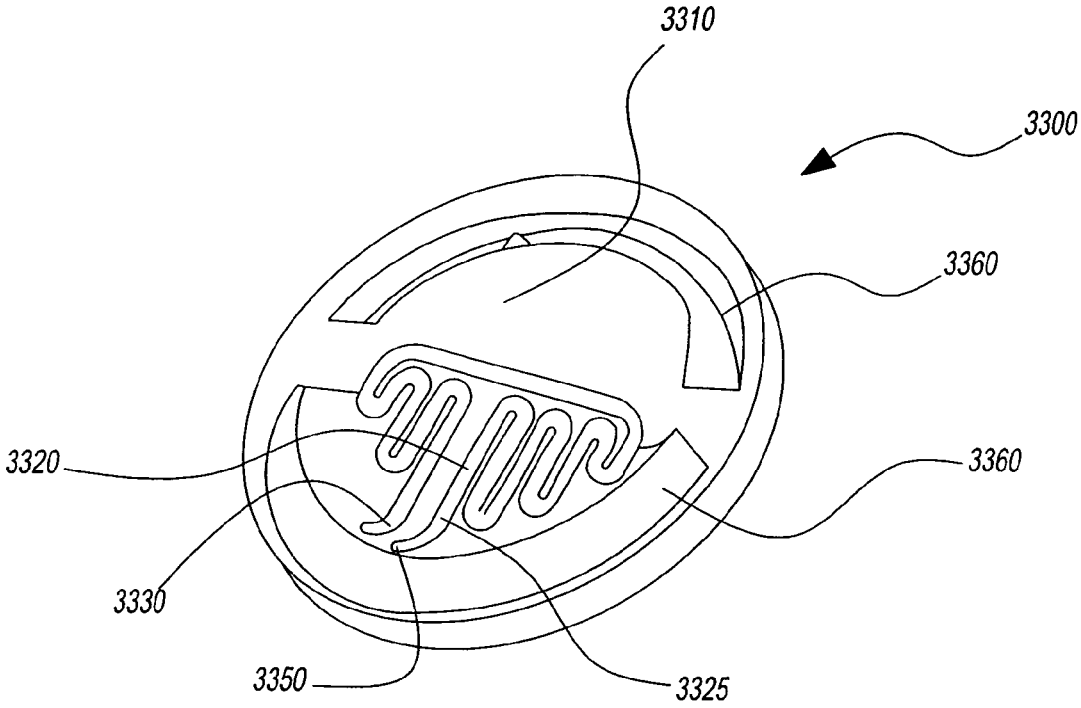
FIG. 17 is a top perspective view of an alternative embodiment of a spill and shake-out inhibiting element or disc, of the present invention.

Referring to FIG. 17, another alternative embodiment of the disc of the present invention is shown and generally represented by reference numeral 3300. Disc 3300 has an upper surface 3310, an orifice 3350 and orientation structures 3360. Upper surface 3310 has a channel or groove 3320 formed therein. Channel 3320 has an inlet 3325 and an outlet 3330.

Inlet 3325 has an orifice 3350 disposed therethrough. Inlet 3325 and outlet 3330 are disposed adjacent to each other on upper surface 3310. Channel 3320 has a variation of a serpentine-like path or shape. Disc 3300 sealingly engages with cap 200 to form the dispensing tunnel or spillage and shake-out inhibiting element of this embodiment.

Figure 18:
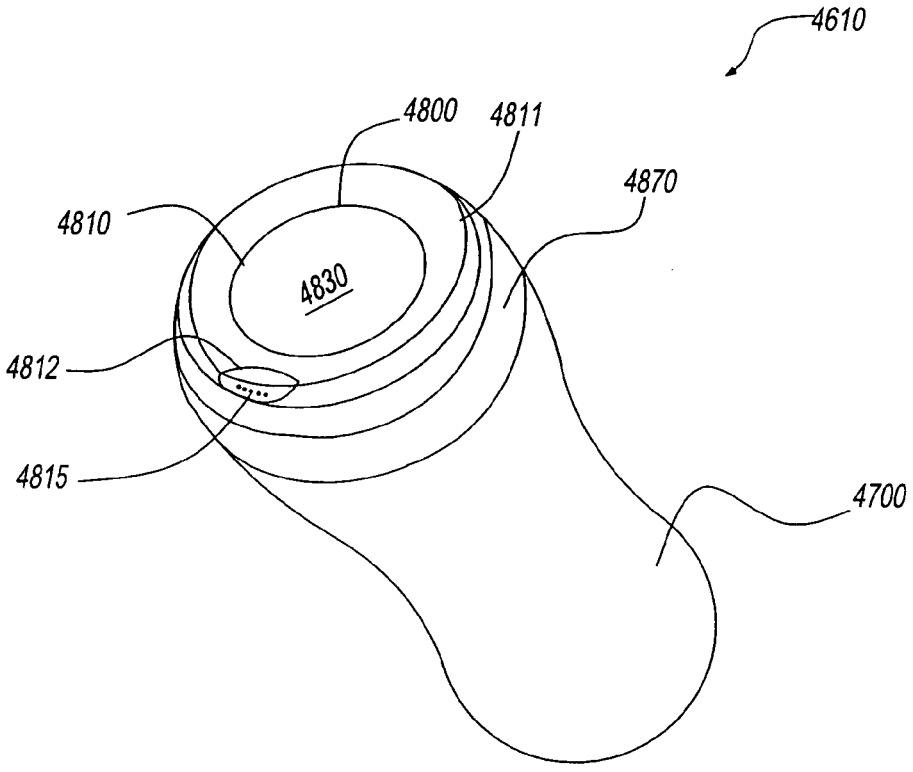
FIG. 18 is a top perspective view of the cup assembly of FIG. 1 with an alternative embodiment of the cap.
Figure 19:
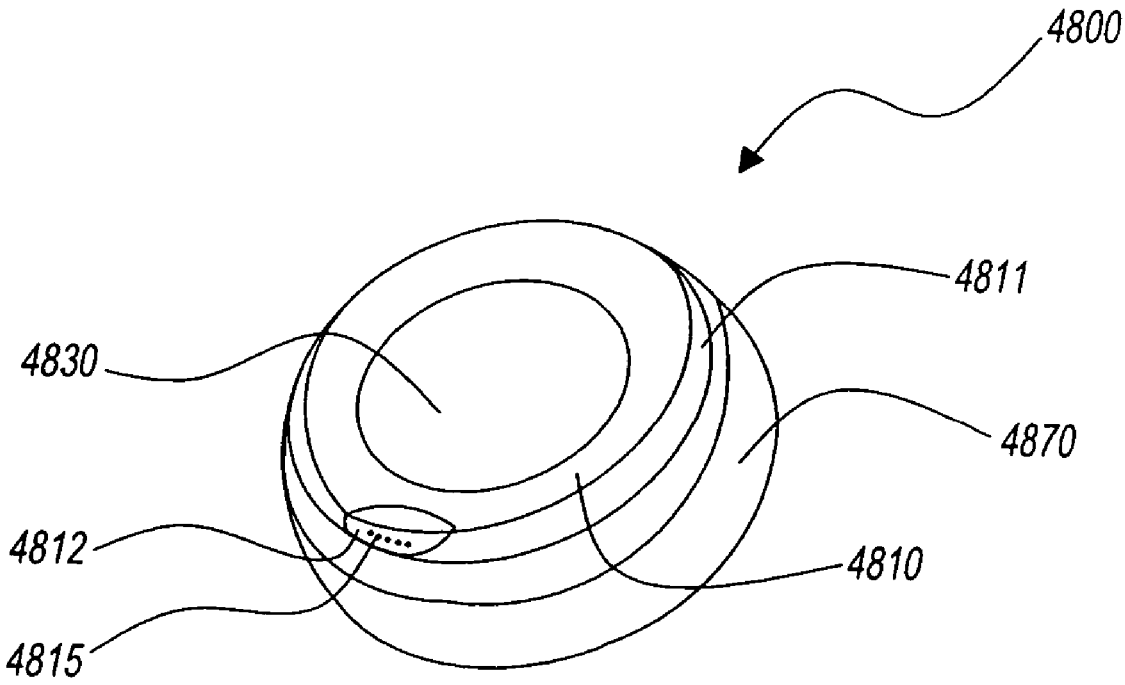
FIG. 19 is a top perspective view of the cap of FIG. 18.

Referring to FIGS. 18 and 19, an alternative embodiment of the cup assembly of the present invention is shown, and generally represented by reference numeral 4610. Cup assembly 4610 has a cup 4700, a cap 4800 and a spill and shake-out inhibiting element or disc 4900 (not shown). Disc 4900 can be one of the embodiments described above or can be a variation of these embodiments to form dispensing tunnel 5000. Cap 4800 has a top wall 4810 with an upper surface 4830. Cap 4800 also has a circumferential sidewall 4870 extending downwardly from, and surrounding, top wall 4810.

Top wall 4810 preferably has a concave or recessed shape along an outer periphery and a flat shape along a center portion.

Top wall 4810 is defined along its circumference by a drinking rim 4811. However, alternative shapes for top wall 4810 can also be used including flat or convex. Top wall 4810 has a dispensing indicator 4812 with a number of openings 4815 disposed therethrough. Five openings 4815 are shown, however, any number of openings can be used. Openings 4815 are aligned with and connected to closed end 4930 of channel or groove 4920 in disc 4900 (not shown) to provide fluid communication between cup 4700, dispensing tunnel 5000, openings 4815 and the user's mouth.

While the present invention has a cap 200 with a drinking rim 211, alternative embodiments can have a spout instead. In such an alternative cap, disc 300, for example, having channel 320, can be adapted to abut against lower surface 250 of the cap, and the spout would be in fluid communication with outlet 330 of the channel. Such an alternative embodiment would provide fluid communication between cup 100, dispensing tunnel 400, the spout and the user's mouth.

Additionally, while the present invention includes a cap 200 and a disc 300 having a channel 320 such that sealing engagement of the disc with lower surface 250 of the cap forms dispensing tunnel 400, i.e., the spill and shake-out inhibiting element, alternative embodiments of cup assembly 10 can have dispensing tunnel 400 formed in other ways. Preferably, dispensing tunnel 400 is disposed below the upper surface of cap 200. Examples of such alternative ways of forming dispensing tunnel 400 include, but are not limited to, channel 320 formed in lower surface 250 of cap 200 and a disc 300 having a flat upper surface 310 whereby cap 200 and disc 300 engage to form dispensing tunnel 400; corresponding channels 320 formed in both upper surface 310 of disc 300 and lower surface 250 of cap 200 whereby the corresponding channels mate to form dispensing tunnel 400; a dispensing tunnel 400 formed in cap 200; a dispensing tunnel 400 formed in disc 300; or a tubular dispensing tunnel 400 with an inlet in fluid communication with the inner volume of cup 100 and an outlet connected to opening 215. Where two separate parts are mated to form dispensing tunnel 400, a flexible or elastomeric surface can be used for one of the parts to provide for proper sealing of the dispensing tunnel.

The present invention provides a spill and shake-out inhibiting element, i.e., dispensing tunnel 400, that does not require a blockage or obstruction in the flow path and thus simplifies manufacturing, as well as use. Dispensing tunnel 400 preferably has a rounded flow path without sharp corners, which would induce turbulence during suction. Some contemporary devices attempt to control the flow during suction by using sharp-cornered turns along the flow path, which induce turbulence but fail to prevent spillage during shaking. The present invention inhibits spillage or shake-out even during shaking. Additionally, the present invention allows for positioning of dispensing tunnel 400 along any portion of cap 200, as opposed to some of the contemporary devices, which are limited to specific flow paths along the outer circumference of the cap.

Additionally, the cup assembly 10 can provide for venting of the vacuum developed in the inner volume 110 of cup 100 during application of suction by the user. The vent mechanism or method preferably provides venting at or above a predetermined negative pressure which corresponds to the vacuum developed during use, but does not vent below the predetermined negative pressure which corresponds to the negative pressure in the inner volume that is sufficient to prevent spilling or shake-out when the cup assembly is not in use but has been tilted or inverted. Alternative venting mechanisms and methods can also be employed, as well as not venting the inner volume of cup 100. Such alternative methods and mechanisms preferably vent the inner volume 110 of cup 100 when suction is being applied due to drinking but do not, or substantially do not, vent the inner volume of the cup when the cup has been tilted or inverted and a negative pressure arises in the inner volume due to dispensing tunnel or passageway 400.

The present invention having been thus described with particular reference to the preferred forms thereof, it will be obvious that various changes and modifications may be made therein without departing from the spirit and scope of the present invention as defined by the appended claims.

The invention claimed is:

1. A bottle assembly comprising:

a cap having a top wall, a circumferential sidewall, and a first connecting structure, said top wall having an area and a perimeter surrounding said area and a center axis extending between a first point that is opposite to a second point on said perimeter, said circumferential sidewall surrounding said top wall, said first connecting structure being disposed on said circumferential sidewall;

a cup having an inner volume and a second connecting structure, said first and second connecting structures connecting said cap with said cup; and a valve having a single dispensing passageway with first and second ends, said first end being open and in fluid communication with said inner volume of said cup, said second end being open and in fluid communication with atmosphere, said single dispensing passageway being disposed entirely on a portion of said area of said top wall extending between one half of said perimeter and said center axis of said area of said top wall, wherein said top wall has a portion that is recessed with respect to said circumferential sidewall to form a lip, wherein said lip has an opening therethrough that is in fluid communication with said first and second ends of said passageway, and wherein said passageway has a cross-sectional area that is small enough to substantially prevent air from flowing past fluid in said passageway when said cup is tilted or inverted.

2. The bottle assembly of claim 1, wherein said passageway is disposed in a first planar section having a first longitudinal axis, wherein said cap is disposed in a second planar section having a second longitudinal axis, and wherein said first and second longitudinal axes are substantially parallel.

3. The bottle assembly of claim 1, wherein said passageway has a length and a dispensing volume, and wherein said length and said dispensing volume are large enough to substantially prevent spillage or shake-out of said fluid from said inner volume of said cup when said cup is tilted or inverted.

4. A bottle assembly comprising:

a cap having a top wall and a first connecting structure, said top wall having an upper surface, said top wall having an area and a perimeter surrounding said area and a center axis extending between a first point that is opposite to a second point on said perimeter;

a cup having an inner volume and a second connecting structure, said first and second connecting structures connecting said cap with said cup; and a valve having a single passageway with first and second ends, said first end being open and in fluid communication with said inner volume of said cup, said second end being open and in fluid communication with atmosphere, said single dispensing passageway being disposed entirely on a portion of said area of said top wall extending between one half of said perimeter and said center axis of said area of said top wall, wherein said single passageway has a cross-sectional area that is small enough to substantially prevent air from flowing past fluid in said single passageway when said cup is tilted or inverted, wherein said single passageway has a volume so that said fluid does not exceed a predetermined distance away from said second end that is open and in fluid communication with atmosphere with any degree of fill in said cup, and wherein said single passageway is substantially disposed below said upper surface of said cap.

5. The bottle assembly of claim 4, wherein said single passageway is disposed in a first planar section having a first longitudinal axis, wherein said cap is disposed in a second planar section having a second longitudinal axis, and wherein said first and second longitudinal axes are substantially parallel.

6. The bottle assembly of claim 4, wherein said single passageway has a length, and wherein said length is large enough to substantially prevent spillage or shake-out of said fluid from said inner volume of said cup when said cup is tilted or inverted.

7. The bottle assembly of claim 4, wherein said single passageway has a serpentine-like path.

8. A cap and a disc assembly that is connectable to a cup, the cap and disc assembly comprising:

the cap having a top wall, a circumferential sidewall, and a first connecting structure, said circumferential sidewall surrounding said top wall, said first connecting structure being disposed on said circumferential sidewall that is connectable to the cup, said top wall having a top surface and a bottom surface opposite to said top surface, said bottom surface having a bottom area and a perimeter surrounding said bottom area and a center axis extending between a first point that is opposite to a second point on said perimeter, said bottom area having a sealing bead formed in said bottom surface disposed entirely on a portion of said bottom area extending between one half of said perimeter and said center axis of said bottom area;

the disc having an upper surface defining a upper area, said upper surface having a channel formed in said upper surface on one-half or less than one-half of said upper area, said cap and said disc being connected so that said sealing bead and said channel form a valve having a single dispensing passageway with first and second ends, said first end being open and in fluid communication with an inner volume of the cup, said second end being open and in fluid communication with atmosphere, wherein said passageway has a cross-sectional area that is small enough to substantially prevent air from flowing past fluid in said passageway when said cup is tilted or inverted.

* * * * *